United States Patent [19]

Wittig et al.

[11] 4,213,823

[45] Jul. 22, 1980

[54] PAPER MAKING MACHINE SCREEN WITH STAGGERED FOILS

[75] Inventors: Carl E. Wittig, Becket; Raymond C. Vonderau, Lenox, both of Mass.

[73] Assignee: Beloit Corporation, Beloit, Wis.

[21] Appl. No.: 33,730

[22] Filed: Apr. 26, 1979

[51] Int. Cl.[2] ..... D21D 5/02

[52] U.S. Cl. ..... 162/380; 209/273; 209/379; 210/415

[58] Field of Search ..... 162/342, 380, 60; 209/273, 250, 300, 305, 306, 379; 210/79, 415, 407

[56] References Cited

U.S. PATENT DOCUMENTS

| | | | |
|---|---|---|---|
| 3,456,793 | 7/1969 | Salomon | 209/273 |
| 4,111,799 | 9/1978 | Cancilla | 209/273 |
| 4,126,513 | 11/1978 | Justus et al. | 162/380 |

FOREIGN PATENT DOCUMENTS

| | | | |
|---|---|---|---|
| 2548578 | 12/1977 | Fed. Rep. of Germany | 209/273 |

*Primary Examiner*—S. Leon Bashore
*Assistant Examiner*—Peter Chin
*Attorney, Agent, or Firm*—Hill, Van Santen, Steadman, Chiara & Simpson

[57] ABSTRACT

The stock slurry pulsing rotary foils in a cylindrical paper making machine screen comprise sets which are shorter than the screen and respectively extend from opposite ends of the screen and have their inner end portions alternating in circumferentially spaced but axially overlapping relation. Thereby, the frequency of the hydraulic pulses transmitted directly to the accepts outlet is increased, but the total amplitude of the foil pulses transmitted to the outlet pipe is reduced, and this is accomplished without significant change in horsepower for driving the foil means, as compared with an arrangement of half the total number of foils wherein each foil extends throughout the effective length of the screen.

7 Claims, 4 Drawing Figures

PAPER MAKING MACHINE SCREEN WITH STAGGERED FOILS

This invention relates to paper making machine apparatus and method and is more particularly concerned with a new and improved paper making machine screen with staggered foils and method of increasing the effective pulse frequency.

Stock screens are used in the paper making process for aiding in cleaning the stock before it flows to the headbox to be dewatered to form a web. Such stock screens are conventionally tubular in shape with the stock being directed either to the inner surface or the outer surface of the tubular screen with the accepted stock flowing through the screen and the rejected stock including sheaves, particles, dirt, knots, etc., not passing through the screen and removed through a reject line. Typically, in the case where the supply stock is delivered to the inside of the screen and the stock flows outwardly through the screen in the screening operation, the stock to be screened may be admitted by flowing in at one end of the tubular screen, and the rejects flowing out of the other end, while the accepts are received by and discharged from an annular chamber about the screen. Such devices are shown in U.S. patents to Cancilla U.S. Pat. No. 4,111,799 directed to a generally horizontally disposed stock screen assembly, and Justus et al U.S. Pat. No. 4,126,513 directed to a vertically extending stock screen assembly. In each of those patents, it is contemplated that each of the stock pulsing foils extend throughout substantially the entire effective length of the screen. Adaptation of this principle is also applicable to screens wherein the foils are external to the screen and wherein the flow is from external to the screen to the interior of the screen.

In the conventional operation of the stock screen, the foils extend the length of the screen and rotate to effect continuous passing of the foils at uniform speed over the surface of the screen to cause relatively low frequency high amplitude pressure pulsations. While such pressure pulsations are necessary to the satisfactory operation of the screen, they introduce corresponding pressure pulsations in the stock delivery to the headbox. Such pressure pulsations will disturb uniform distribution of the stock and will have an adverse effect on flow of the stock through the slice opening onto the web forming surface. It is essential for satisfactory high speed operation and good formation that the pulse fluctuations be substantially eliminated or produced at a satisfactory high frequency, to avoid machine direction instability of the stock flow onto the web forming surface such as a fourdrinier wire and to at least reduce the liability of causing a basis weight variation in the machine direction.

It is, accordingly, an object of the present invention to provide an improved paper making machine stock screening device and method effective in the flow supply to the headbox to increase the frequency of the hydraulic pulses through the screen with reduced total amplitude of the pulses transmitted to the accepts outlet and thus to the headbox of the machine, as compared with conventional arrangements.

In an embodiment of the invention, a paper making machine screen apparatus for processing stock flowing to a headbox comprises in combination an elongate cyclindrically tubular screen, a housing enclosing said screen, supply means for supplying stock slurry into said housing to flow through said screen, stock accepting means including an outlet pipe for receiving stock from said screen, discharge means for receiving material not passing through the screen, axially extending foil means mounted to rotate relative to said screen for generating pressure pulsations to move acceptable slurry through said screen, means for driving said foil means rotatably, said foil means comprising a plurality of foils arranged to move in circumferential direction along an adjacent face of said screen in the rotation of said foil means, and at least some of said foils being axially substantially shorter than said screen and being in circumferentially offset interdigitated relation to other of said foils, whereby the frequency of pulsations is increased but the total amplitude of the pulsations in the outlet pipe is reduced as compared with an arrangement in which all foils extend substantially the full length of the screen.

A method of practicing the invention comprises processing stock flow to a headbox by means of a paper making machine screen apparatus which has an elongate cylindrical tubular screen, a housing enclosing said screen, means for supplying stock slurry into said housing to flow through said screen, stock accepting means including an outlet pipe for receiving stock from said screen, and discharge means for receiving material not passing through said screen, the method comprising providing sets of pressure pulsation generating foils of which at least some of the foils are substantially shorter than said screen, mounting said foils in circumferentially spaced relation to one another and rotating said foils in unison along a face of the screen and thereby generating pressure pulsations and moving acceptable slurry through said screen, the frequency of pulsations being increased but the total amplitude of the pulsations in the outlet pipe being reduced as compared with an arrangement having foils extending substantially the full length of the screen.

Other objects, features and advantages of the invention will be readily apparent from the following description of a certain representative embodiment thereof, taken in conjunction with the accompanying drawing although variations and modifications may be effected without departing from the spirit and scope of the novel concepts embodied in the disclosure and in which.

Figure 1:
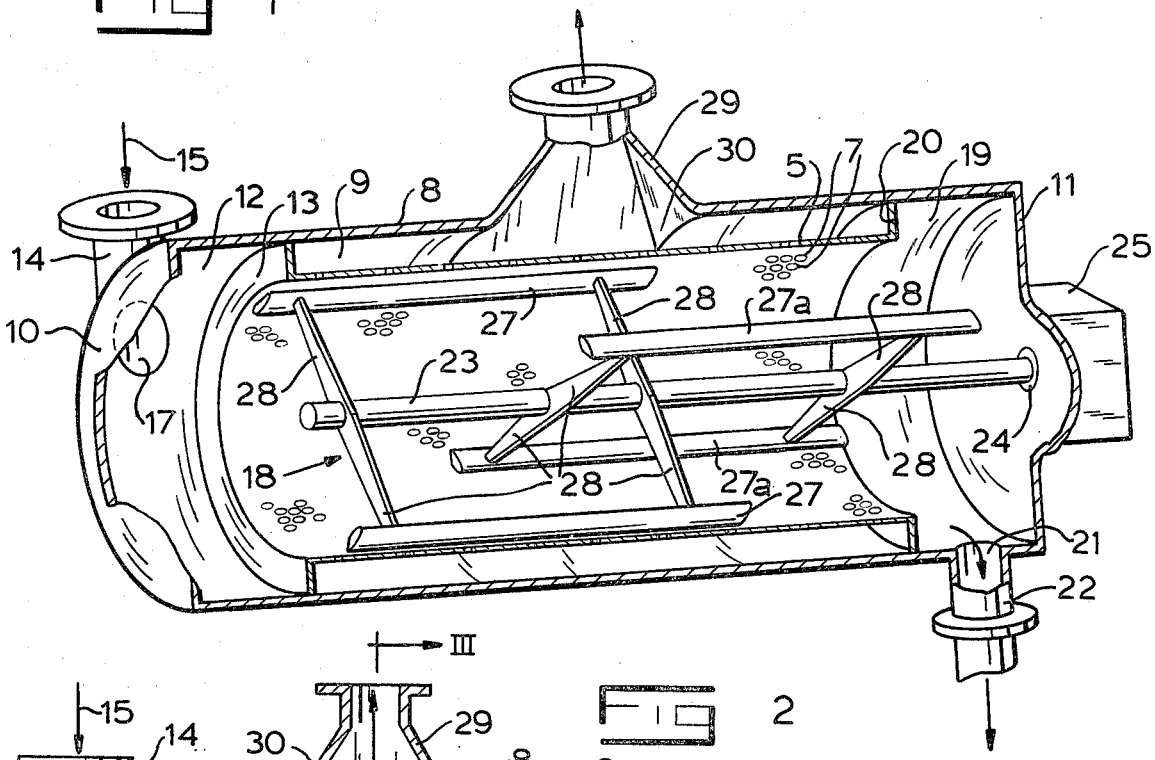
FIG. 1 is an isometric longitudinal sectional view through a paper making stock screen apparatus embodying principles of the present invention.
Figure 2:
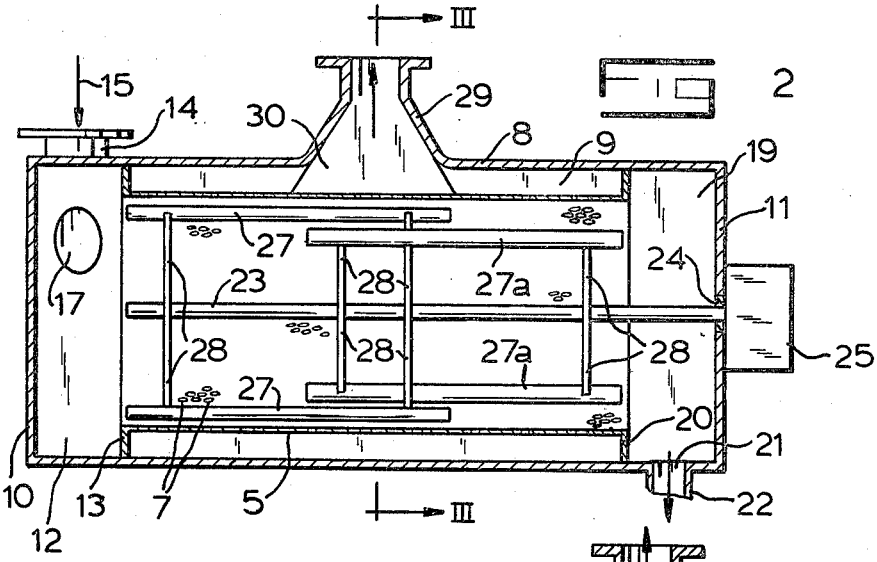
FIG. 2 is a longitudinal sectional elevational view of the same apparatus.
Figure 3:
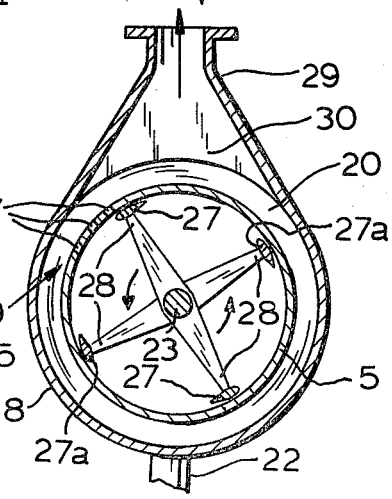
FIG. 3 is a transverse vertical sectional view taken substantially along the line III—III of FIG. 2.

As exemplified in FIGS. 1–3, a paper machine screen apparatus embodying the invention comprises an elongate cylindrical tubular foraminous screen 5 having throughout its effective length perforations 7 of a size and array suitable to pass acceptable fibers and to reject unacceptable fibers and foreign material such as dirt, sheaves and knots.

A housing 8 encloses and surrounds the screen 5 and provides an annular chamber 9 outside of the screen for receiving acceptable slurry. At opposite ends, the housing 8 has respective end walls 10 and 11. Between the end wall 10 and the adjacent spaced end of the screen 5 is defined within the housing 8 a supply chamber 12 which opens into the screen but is closed off from the chamber 9 by an annular partition 13 extending radially from the end of the screen to the housing 8. A supply inlet 14 receiving paper making stock from suitable source indicated by the arrow 15 discharges through a port 17 tangentially into the supply chamber 12 in such manner that centrifugal delivery of the stock is effected from the supply chamber 12 into the screen 5 in the same centrifugal direction in which the stock is processed in the screen 5 by means of axially extending foil means 18 rotatably mounted within the screen for generating pressure pulsations to move acceptable slurry through the screen into the chamber 9.

At the end of the screen 5 which is located in axially spaced relation to the end wall 11, material not passing through the screen 5 is received in a reject chamber 19 between the end wall 11 and the adjacent end of the screen 5 and closed off from the chamber 9 by a radially extending annular partition 20 extending from the end of the screen to the housing 8. Discharge means from the chamber 19 comprise a discharge port 21 opening into a reject line or duct 22.

It will be appreciated, that although the apparatus as illustrated is of the horizontally positioned type, if preferred, the apparatus may be disposed vertically with the supply stock being fed in at the top end and the rejects being removed at the bottom end of the housing 8.

In a preferred construction, the foil means 18 comprises an axially extending rotary shaft 23 extending through a leak-proof bearing 24 in the end wall 11, and driven rotatably by any suitable means 25.

A plurality of sets of foils 27 and **27*a* are mounted on the shaft 23 in a manner to move along the inner face of the screen 5 in the rotation of the shaft. The means for mounting the foils 27, 27*a* on the shaft 23 comprise as thin or narrow as practicable radially extending arms 28 connected at one of their ends to the shaft and at their opposite ends to respective ones of the foils 27**.

According to the principles of the present invention, the foils 27, **27*a* are substantially shorter than the screen 5. The set of foils 27 extends from one end of the screen 5 inwardly with the inner end portions of the foils at a central area of the screen, and the foils 27*a* extend from the opposite end of the screen 5 inwardly with their inner end portions interdigitated with the inner end portions of the foils 27 at said central area of the screen. In the illustrated example, there are a plurality of pairs of the foils 27 and 27*a* in the respective sets of foils arranged in diametrically opposite pairs in each set for rotor balance, and the foils of each pair in each set are offset or staggered relative to the adjacent pairs of foils of the other set both circumferentially and axially relative to the screen. Each of the foils 27 and 27*a* is attached to the shaft 23 by means of a pair of the arms 28**, substantially as shown.

Each of the foils 27 may also be considered as one of a pair with the next adjacent foil **27*a* in either circumferential direction having regard to the screen 5. As may be observed in FIG. 3, the foils 27 and 27*a* are desirably equally spaced in the circumferential direction. Each alternating foil 27 and 27*a* considered in either circumferential direction extends from a respective opposite end of the screen 5** toward the longitudinally central area of the screen.

At the central area of the screen, the adjacent inner ends of the foils 27 and **27*a* which are in longitudinally overlapping but circumferentially spaced relation opposite stock accepting means comprising an outlet 29 leading from the chamber 9 through the wall of the housing 8 and adapted to connect with a headbox (not shown) so that acceptable stock slurry pulsed through the screen 5 into the chamber 9 will flow with desirable system pressure into and through the headbox and its associated slice to the forming surface of the paper making machine of which it is a component. It will be understood, of course, that system pressure is primarily a function of stock supply pump means, the foil means 18 being an assistance for advancing acceptable stock slurry through the screen 7. For best results, the accepts outlet 29 is located generally aligned with the longitudinally central area of the screen 5. As shown, each of the inner end portions of the foils 27 and 27*a* extend substantially entirely across the width of the outlet 29, and more particularly an outlet port 30 defined in the wall of the housing 8 at the exit into the outlet 29. It will be appreciated that principles of the invention are applicable to a generally conventional screen arrangement wherein the foils operate along the outer face of the screen rather than along the inner face as represented in the example illustrated. In an arrangement wherein the foils operate along the outer or exterior face of the screen, the direction of stock flow is through the screen toward the interior of the screen, rejects being drawn off at one end of the screen and acceptable stock leaving the screen from its opposite end, as is customary in such arrangements. Whether the foils 27 and 27*a*** are located at the inner face or at the outer face of the screen, their interdigitated inner end relationship will be substantially the same.

In apparatus where the outlet is located other than aligned with about the longitudinal central area of the screen, appropriate modification in the foil means may be effected. By way of example, in FIG. 4, the outlet 29 is located closer to the left end of the screen 5. In such case, the foils **27*a* are of greater length so that their left-hand end portions extend at least across the area of the screen 5 aligned with the outlet 29. The other set of foils 27 in this instance are of a substantially shorter length and located to function on that area of the screen 5 which is aligned with the outlet 29. In this arrangement, the combined lengths of the foils 27 and 27*a* is not substantially different from the combined length of the foils 27 and 27*a* in FIGS. 1 and 2, and therefore the horsepower or energy consumption for driving the foil means of FIG. 4 is not substantially different from the horsepower or energy consumption required for the arrangement in FIGS. 1 and 2**.

Figure 4:
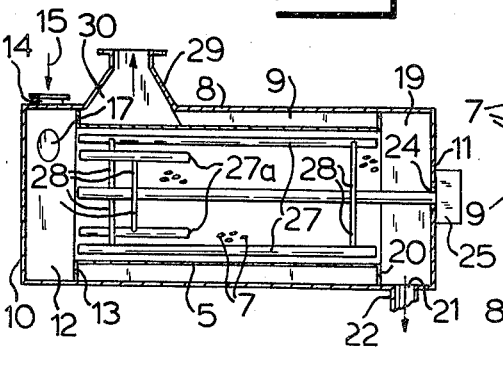
FIG. 4 is a schematic illustration of another embodiment of the invention.

It will be understood, of course, that if the outlet 29 is located closer to the left-hand end of the screen 5 as viewed in FIG. 4, then location of the short foils, whether 27 or **27*a* will be at the left end portion of the screen 5 in alignment with the area of the screen aligned with the outlet 29. Accordingly, the arrangement of the foils can be readily modified to accommodate any particular location of the outlet 29 relative to the screen 5** while nevertheless attaining substantially the same results.

Whether the foils 27 and **27*a* are operative at the inner or the outer face of the screen, the frequency of pulsations generated by the two sets of foils is increased, but the total amplitude of the pulsations transmitted to the outlet pipe from the outlet 29 is reduced, as compared with a conventional arrangement employing foils extending substantially the full length of the screen. Further, in an arrangement as referred to in FIG. 4, the set of shorter foils provide minor pulses intermediate the main pulses generated by the full length foils and thus tend to fill in the valleys between the main or larger pulses generated by the longer foils, for efficiently reducing the pulsation effect in the line. The foil means comprising the two sets of foils 27 and 27***a* is adapted to be driven without significant increase in horsepower or energy consumption as compared with an arrangement in which half the total number of the foils extend substantially the full length of the screen for the same speed of rotation. A salient advantage attained by the present invention is that because of the higher frequency of the hydraulic pulses per revolution of the foil means 18 with less total amplitude of pressure pulses in the outlet pipe to the paper former, disruption in flow of the acceptable stock slurry to the former of the paper machine is substantially minimized.

It will be understood that variations and modifications may be effected without departing from the spirit and scope of the novel concepts of this invention.

We claim as our invention:

1. A paper making machine screen apparatus for processing stock flowing to a headbox comprising, in combination:

an elongate cylindrically tubular screen;

a housing enclosing said screen;

supply means for supplying stock slurry into said housing to flow through said screen;

stock accepting means including an outlet pipe for receiving stock from said screen;

discharge means for receiving material not passing through the screen;

axially extending foil means mounted to rotate relative to said screen for generating pressure pulsations to move acceptable slurry through said screen;

means for driving said foil means rotatably;

said foil means comprising a plurality of foils arranged to move in circumferential direction along an adjacent face of said screen in the rotation of said foil means;

and at least some of said foils being axially substantially shorter than said screen and being in circumferentially offset interdigitated relation to other of said foils;

whereby the frequency of pulsations is increased but the total amplitude of the pulsations in the outlet pipe is reduced as compared with an arrangement in which all foils extend substantially the full length of the screen.

2. Apparatus according to claim 1, wherein said foils extend alternately from opposite ends of said screen toward a central area of said screen, and adjacent ends of said foils are in longitudinally overlapping but circumferentially spaced relation at said central area of said screen.

3. Apparatus according to claim 2, wherein said stock accepting means has an outlet port of substantial diameter leading from said housing opposite said central area of the screen, and said adjacent ends of said foils extending substantially completely across a width of said central portion of said screen about equal to said outlet port diameter.

4. Apparatus according to claim 1, wherein said foils comprise two sets of the foils, each set of foils being axially shorter than said screen, and the foils of each set being offset relative to the foils of the other set both circumferentially and axially within the screen.

5. Apparatus according to claim 1, wherein said foil means comprises a shaft extending coaxially within said screen, and each foil has a plurality of arms attaching the foil to said shaft.

6. Apparatus according to claim 1, wherein said stock accepting means has an outlet port to the outlet pipe and said outlet port is located substantially closer to one end of the screen than to the opposite end of the screen, certain of said foils axially extending from said opposite end of the screen to and in substantially overlapping relation to the area of said screen aligned with said outlet port, and alternate foils being axially substantially shorter than said certain foils and extending from said one end of the screen and having their inner end portions extending across said area of the screen aligned with said outlet.

7. Apparatus according to claim 1, in which certain of said foils extend axially substantially the length of said screen, and alternate ones of said foils being of substantially shorter length whereby to effect said increase in frequency of pulsations but reduced total amplitude of pulsations.

* * * * *